US005443325A

United States Patent [19]

Simonelli et al.

[11] Patent Number: 5,443,325

[45] Date of Patent: Aug. 22, 1995

[54] ASPHALT FUME REDUCTION SYSTEM

[75] Inventors: Michael T. Simonelli, Mattoon; John D. Padgett, Charleston; Garry Bowhall, Champaign, all of Ill.

[73] Assignee: Blaw-Knox Construction Equipment Corporation, Mattoon, Ill.

[21] Appl. No.: 192,129

[22] Filed: Feb. 4, 1994

[51] Int. Cl.[6] ..... E01C 7/00

[52] U.S. Cl. ..... 404/75; 404/108

[58] Field of Search ..... 404/75, 95, 101, 105, 404/108, 113, 17

[56] References Cited

U.S. PATENT DOCUMENTS 3,946,646 3/1976 Gassner, Jr. .
4,226,552 10/1980 Monench ..... 404/75 X
4,379,653 4/1983 Brown .
4,473,320 9/1984 Register ..... 404/75 X
4,557,626 12/1985 McKay et al. ..... 404/95 X
4,561,800 12/1985 Hatakenaka et al. .
4,682,909 7/1987 Mihara ..... 404/95 X

*Primary Examiner*—Michael Powell Buiz
*Attorney, Agent, or Firm*—Pearne, Gordon, McCoy & Granger

[57] ABSTRACT

A paver or other apparatus used to convey paving material is provided with a conduit including a hood and a duct for directing fumes from the paving material to a fume processor. A paver having an extendable screed or other moving parts is equipped with a roll of screen material. The screen material is unrolled and fastened over the extended screed to contain and direct the fumes to the conduit. The fumes are burned in an engine of the paver or otherwise processed to remove or reduce noxious components thereof.

18 Claims, 3 Drawing Sheets

ASPHALT FUME REDUCTION SYSTEM

BACKGROUND OF THE INVENTION

1. Field of the Invention

This invention relates generally to the field of paving roads and specifically to reducing fumes from asphalt during paving.

2. Description of the Related Art

Asphalt, comprising tar and an aggregate, such as stone, has long been used as a paving material for roads, parking lots, sidewalks and other surfaces. Hot asphalt is transported to a paving site where it is spread on a graded base surface, such as soil, sand, gravel or old pavement. The asphalt is then leveled or shaped to a desirable configuration in which it cools and hardens to provide a durable paved surface.

In laying asphalt pavement roadways and the like, it is a widespread practice to employ so-called floating screed paving machines. These machines include a tractor-like main frame having an engine for propulsion and for material distributing functions. Typically, there is a material receiving hopper at the front of the paver arranged to receive hot asphalt material from a truck as the paving machine advances along the roadbed. Slat conveyors or the like are provided to convey the material from the hopper, at the front of the machine, toward the floating screed, at the back of the machine. Immediately in front of the screed, there is typically provided a distributing auger, which receives the raw asphalt material from the slat conveyor and conveys it laterally so as to distribute the material along the front edge of the screed. As the machine advances along the prepared roadbed, the raw asphalt material flows under the screed, which levels, smoothes and compacts it to provide a continuous, level pavement mat.

The paving material comprises an aggregate and a bituminous material. The bituminous material is generally asphalt derived from petroleum. The asphalt is composed of hydrocarbons and heterocyclic compounds containing nitrogen, sulfur, and oxygen. Typically these are pre-mixed and transported to the paving site, but they may be mixed on-site or as a part of the paving process. The mixture is sometimes referred to as asphalt or blacktop. A related bitumen, tar, is sometimes used in the same manner as the asphalt or is sprayed onto a surface covered with aggregate. Some of the materials in the asphalt or tar exhale gasses or fumes which are irritating or potentially harmful to persons, plants and animals near the paving operation. In particular, a "screed operator" is typically positioned near the screed and a "paver operator" rides atop the paver as the asphalt is being distributed and leveled. The gasses include undesirable benzine or benzene rings.

It would be desirable to contain the fumes so as to isolate the screed operator and others from the fumes. It would further be desirable to process the fumes so as to remove or reduce the undesirable effects of the components of the fumes before discharging the fumes to the atmosphere.

SUMMARY OF THE INVENTION

The present invention provides an apparatus for conveying paving material. The apparatus includes a paving material conveyance and a fume processor for removing noxious components of fumes exhaled by the paving material. A fume conduit directs the fumes from the conveyance to the processor.

The conveyance may be a paving apparatus and the processor and conduit are preferably carried on board the conveyance. The fume processor includes a heating element for heating the fumes, such as an engine of the paving material conveyance. The fume conduit is connected to an input of the engine so as to burn the fumes in the engine.

Preferably, the fume conduit includes a separator for directing part of the fumes to an intake of the engine and another part of the fumes to an exhaust flow from the engine. The processor may include a filter or a scrubber. A suction means is provided for urging the fumes toward the processor. The suction can be created by the engine. The fume conduit includes a duct for directing the fumes to the processor. The fume conduit also includes a hood for containing and collecting the fumes. The conduit may be a flexible screen at least partly covering the conveyance.

The paving material conveyance may include a screed for levelling the paving material. In such a case, the fume conduit includes a screen over the screed for collecting the fumes around an inlet of the hood. When the screed is extendable, the screen comprises a roll of film having one end attached to the conveyance and another end attached to the screed so as to be extendable therewith. Clamps on the screed releasably attach the screen thereto.

A method of reducing fumes exhaled from paving material carried in a paving material conveyance is also disclosed. The steps include collecting the fumes in a fume conduit; directing the fumes to an intake of an engine of the paving material conveyance; and burning the fumes in the engine. Part of the fumes may be separated and directed to an exhaust flow of the engine.

The description herein focuses on asphalt based paving materials, but could apply to any paving material or coating which exhales harmful or undesirable fumes. Also, the apparatus described is a paver, but could be another conveyance, such as a vehicle.

DESCRIPTION OF THE PREFERRED EMBODIMENTS

Figure 1:
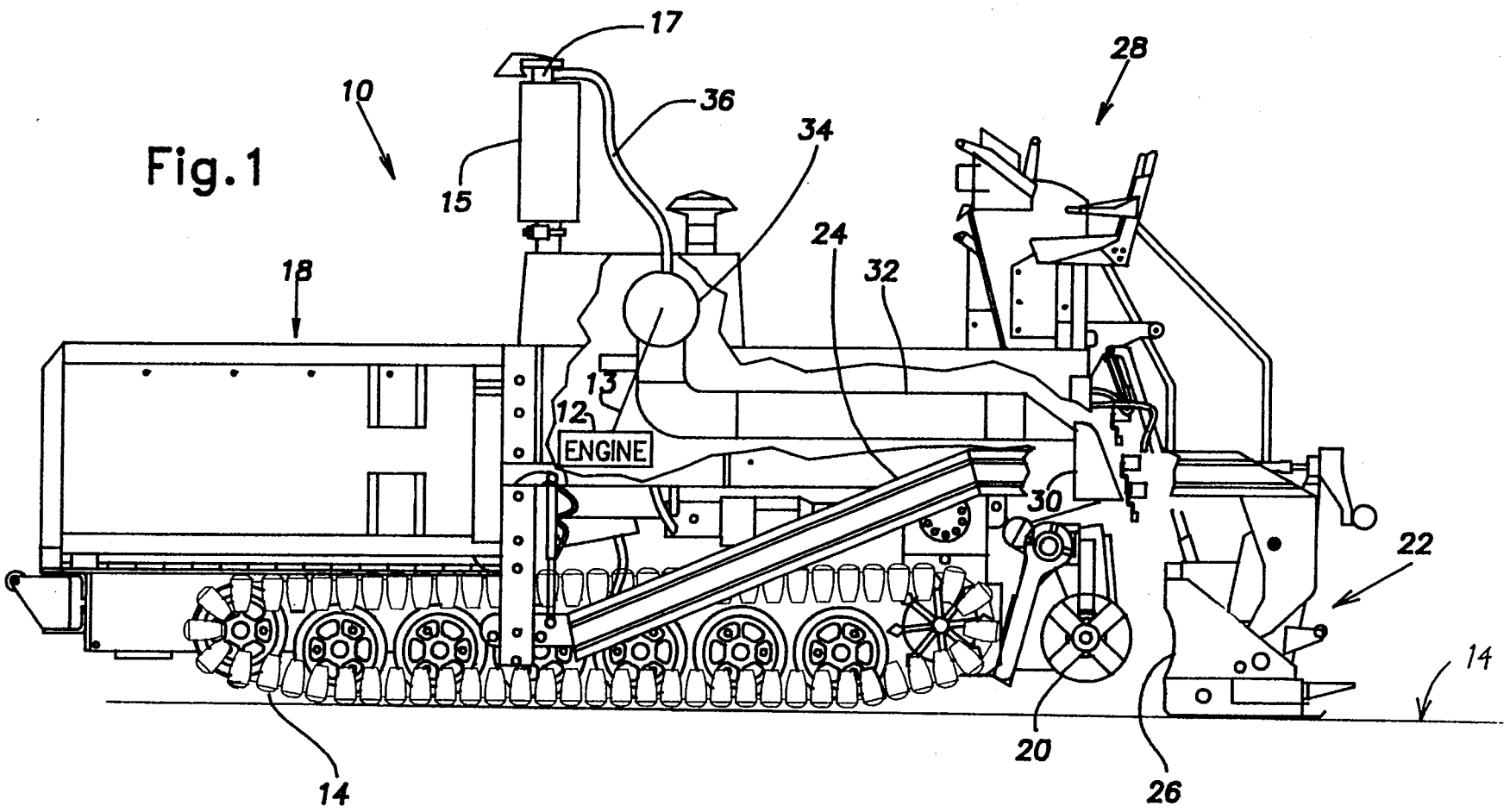
FIG. 1 shows a partially cut away side elevational view of a paver equipped with a fume collection system according to the invention.

Referring to FIG. 1, a paving material conveyance, such as a paver 10 or a dump truck, is adapted to hold or transport paving material. As discussed above, the paving material typically comprises an aggregate and a bituminous material, commonly referred to as asphalt. The paver 10 shown is represenatative of a wide variety of paving material conveyances having different construction and features well known in the art. The paver 10 is powered by an engine 12, preferably of an internal combustion type. The engine has an air intake 13 for air used in the combustion process. Byproducts or waste from the combustion process are exhausted through an exhaust system which includes a muffler 15 and an exhaust pipe 17. The engine 12 drives wheels or a track 14 to move the paver 10 over a surface, such as a roadbed 16 on which the paving material is to be distributed.

A hopper 18 on the paver 10 is adapted to receive paving material from a dump truck, for example. A slat type conveyor (not shown) moves the paving material from the hopper 18 toward the back of the paver 10 through the middle of the paver. A rotating auger 20 distributes the paving material toward sides of the paver 10. A screed 22 is disposed behind the auger 20 for further distributing and levelling the paving material distributed by the auger. The screed 22 is pulled by a pair of tow arms 24 secured to the paver so as to permit the screed to "float," thereby providing a smoothly paved surface despite irregularities in the roadbed 16. The screed 22 includes end gates 26 which prevent paving material from spilling beyond the ends of the screed. One or more control stations 28 are equipped to accommodate an operator who controls operation of the paver and the screed. To this point, the paver 10 and associated apparatus described are well known in the art.

Figure 2:
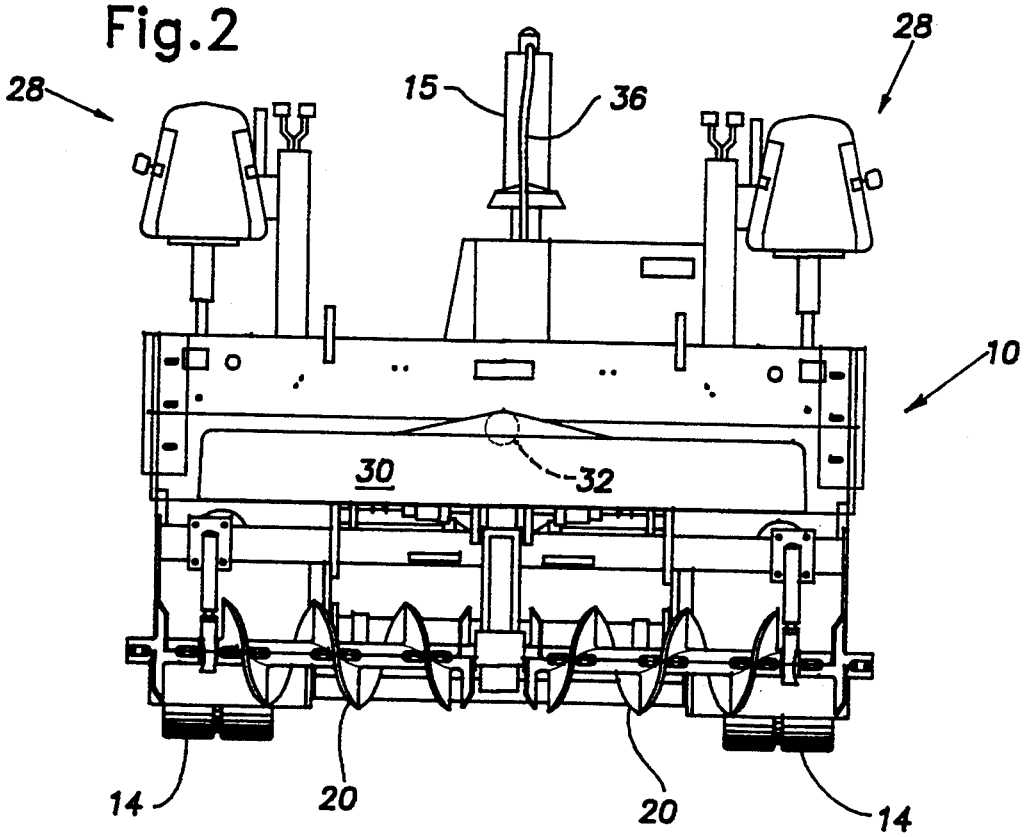
FIG. 2 shows a rear elevational view of the paver with its screed removed.
Figure 3:
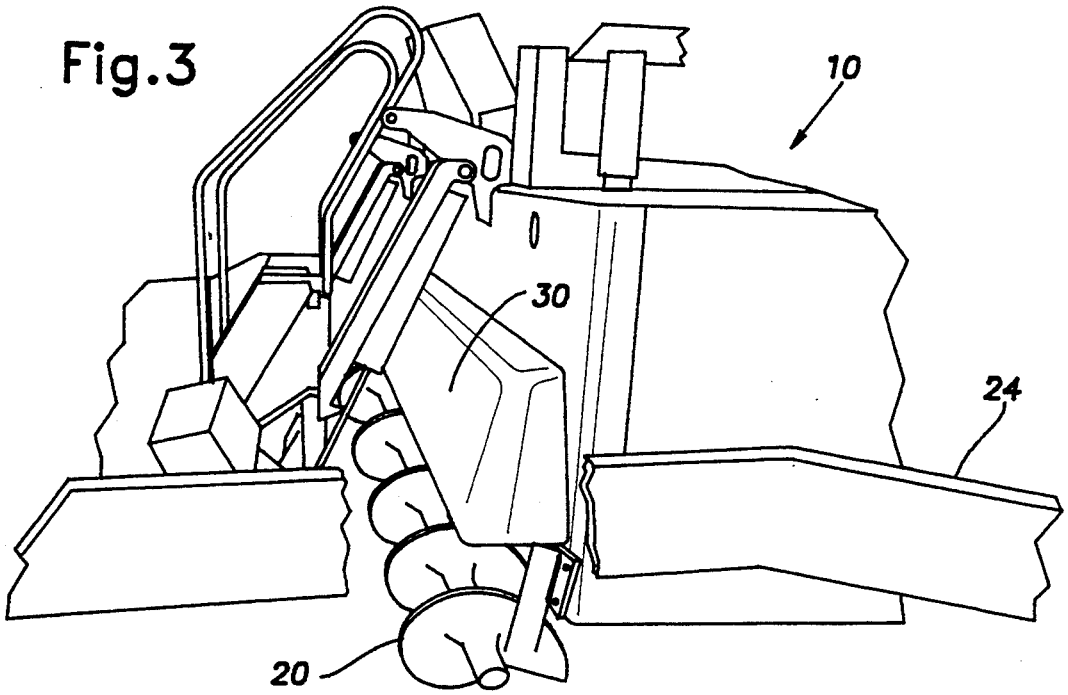
FIG. 3 shows a detailed perspective view of the rear part of the paver and a fume collection hood disposed thereon.

According to a preferred embodiment of the invention, the paver is equipped with a hood 30 disposed above the auger 20. The hood 30 is also shown in FIGS. 2 and 3. The hood 30 is made of fiberglass, steel, or other suitable material which is not substantially degraded by fumes from the paving material or other environmental conditions. The hood 30 may be rigid or flexible. As will become apparent, the hood 30 should be shaped and located so as to contain and collect substantially all of the fumes from the paving material as the paving material is distributed by the auger 20.

Returning to FIG. 1, a duct 32 is in communication with the hood 30. The duct 32 is preferably a rigid pipe of galvanized metal or other suitable material. As shown, the duct 32 extends forwardly from the hood 30 through the paver 10, however the duct may follow any suitable path as will become apparent. The forward end of the duct 32 or conduit communicates with an input of an air cleaner 34, such as a filter and/or an activated charcoal scrubber. The air cleaner 34 is suitable for removing particulate matter or other components from the fumes flowing in the duct 32. One output of the the air cleaner 34 is connected to communicate with the air intake 13 of the engine 12. Another output of the air cleaner is connected to communicate with the exhaust flow from the engine 12, preferably at the exhaust pipe 17, by means of a hose 36, for example. The air cleaner serves as an air separator to direct part of the fumes to the engine 12 and part of the fumes to the exhaust pipe 17. Alternative embodiments could eliminate the air cleaner and use only a separator or all of the fumes could be directed to the engine with or without the air cleaner.

The air cleaner 34, engine 12, and exhaust serve as a fume processor for removing noxious components from the fumes of the paving material. The hood and duct define a conduit for directing the fumes to the fume processor. The fumes are burned in the combustion process in the engine, thereby eliminating or reducing noxious components of the fumes, such as benzine or benzene rings. The engine is preferred as the fume processor since it has been found to be effective and is readily available on pavers and other paving material conveyances. However, a separate fume processor could be used in addition to or in place of the engine. For example, a separately fueled combustion chamber, a series of filters, or a chemical treatment plant could be used.

The suction required for proper flow of the fumes into the fume processor through the hood and the duct is achieved by the natural vacuum created by the engine. This flow is augmented by connecting an output of the air cleaner 34 to the exhaust pipe 17, as shown in FIG. 1. If necessary, additional suction may be generated by a fan, for example. In addition, fumes may be directed toward the conduit or hood by a blower disposed near the screed 22, for example.

In a preferred embodiment, the air cleaner separates the flow to its two outputs shown by quantity. It might also be desirable to separate the flow by quality, for example, where disparate fume processors are used to treat different components of the fumes.

Figure 4:
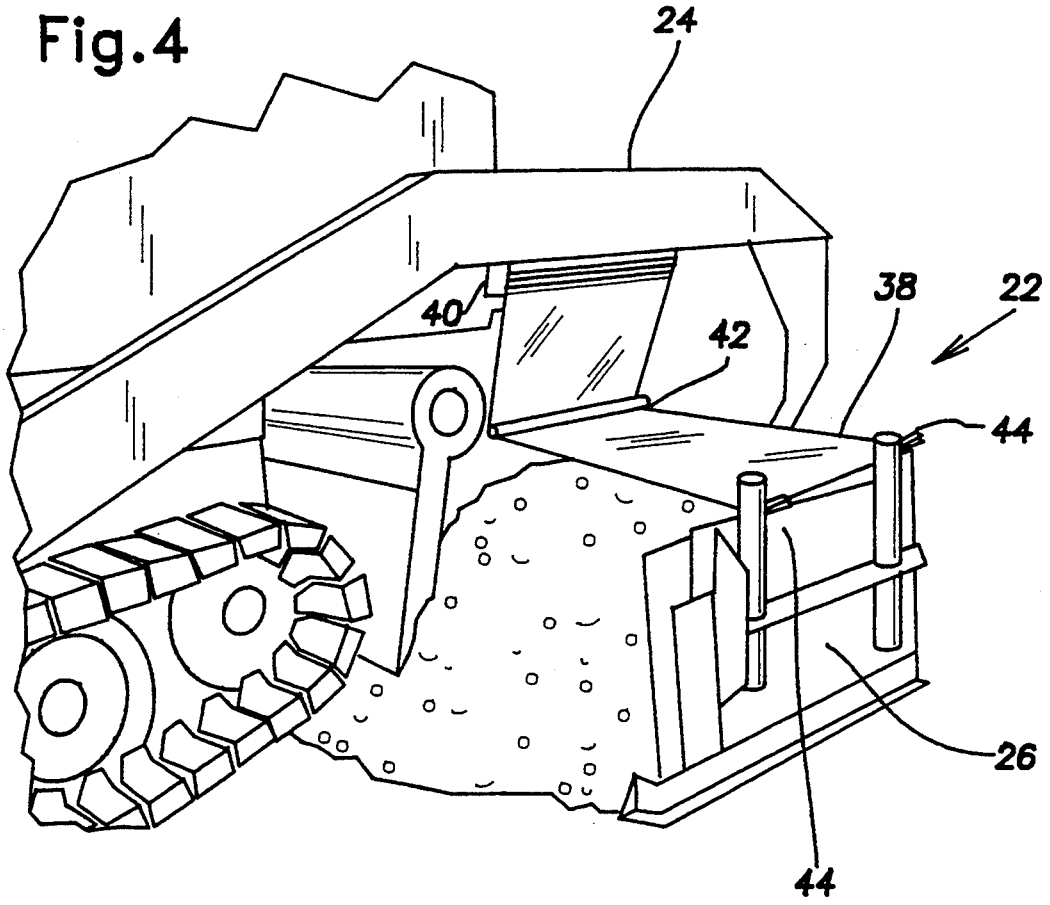
FIG. 4 shows a detailed perspective view of a paver having an extendable screed equipped with a fume collection screen according to the invention.

Referring to FIG. 4, the screed 22 is of an extendable type, as is known in the art and described, for example, in U.S. Pat. No. 4,379,653 to Brown, which is incorporated herein by reference. During transport of the paver 10 on a trailer, for example, the screed is retracted. During paving the screed 22 can be extended laterally so as to permit paving of an area wider than the width of the paver 10.

A screen 38 is provided on a roll diposed in a case 40. The case 40 is mounted on the tow arm 24 above the screed 22. The case may be removably mounted on the tow arm or the roll may be removably mounted in the case. A smooth bar 42, such as a rigid rod, is disposed on a non-extending part of the screed and is generally parallel with the case 40. The screen 38 is unrolled from the case, wrapped partly around the bar 42, and pulled over the screed. A leading end of the screen is fastened on or near the end gate by means of clamps 44. The screen 38 forms an extension of the conduit to cover the screed and contain fumes exhaled by the paving material within the extended screed. The screen and screed cooperate with the hood to direct the fumes into the duct 32 by means of the suction created by the engine 12. The roll of screen material should be spring biased to return to the case when the screed is retracted.

Preferably, the screen is made of 0.020 thick welding curtain, and may be transparent or opaque. The screen can be made from any flexible sheet material which is rollable and sufficiently resistant to heat and fumes from the paving operation. Ideally the screen is inexpensive and disposable. The roll should include surplus screen so that damaged screen can be unclamped and discarded and new screen can be pulled from the case and clamped to the end gate. An exhausted roll of screen material can be replaced.

The screen contains fumes from the paving material and facilitates conveyance of the fumes to the fume processor. The screen can be adapted for other stationary or movable parts in which paving material is to be contained. The necessary combination and configuration of one or more hoods, screens, and ducts will be apparent from the structure of the paver or other conveyance. For example, the conveyance could comprise a dump truck having a retractable screen over the dump body. The duct could be flexible so as to remain connected during dumping. The apparatus need not entirely enclose the paving material, so long as sufficient suction is generated to contain the desired amount of fumes.

The present disclosure describes several embodiments of the invention, however, the invention is not limited to these embodiments. Other variations are contemplated to be within the spirit and scope of the invention and appended claims.

What is claimed is:

1. An apparatus for conveying paving material, said paving material exhaling noxious fumes, the apparatus comprising:

a paving material conveyance;

a fume processor for removing noxious components of the fumes; and a fume conduit for directing the fumes from the conveyance to the processor.

2. An apparatus according to claim 1, wherein the paving material conveyance comprises a paving apparatus.

3. As apparatus according to claim 2, wherein the paving apparatus includes a hopper for receiving paving material and a screed for levelling and paving material.

4. An apparatus according to claim 1, wherein the fume processor includes a heating element for heating the fumes.

5. An apparatus according to claim 4, wherein the heating element is an engine of the paving material conveyance, the fume conduit being connected to an input of the engine so as to burn the fumes in the engine.

6. An apparatus according to claim 5, wherein the fume conduit includes a separator for directing part of the fumes to an intake of the engine and another part of the fumes to an exhaust flow from the engine.

7. An apparatus according to claim 1, wherein the processor includes a filter.

8. An apparatus according to claim 1, wherein the filter includes a scrubber.

9. An apparatus according to claim 1, further comprising a suction means for urging the fumes toward the processor.

10. An apparatus according to claim 1, wherein the fume conduit includes a duct for directing the fumes to the processor.

11. An apparatus according to claim 1, wherein the conduit includes a flexible screen covering at least part of the conveyance.

12. An apparatus according to claim 1, wherein the fume conduit includes a hood for containing and collecting the fumes.

13. An apparatus according to claim 12, wherein the paving material conveyance includes a screed for levelling the paving material and the fume conduit includes a screen over the screed for collecting the fumes around an inlet of the hood.

14. An apparatus according to claim 13, wherein the screed is extendable and the screen comprises a roll of film having one end attached to the conveyance and another end attached to the screed so as to be extendable therewith.

15. An apparatus according to claim 14, further comprising clamps on the screed for releasably attaching the screen thereto.

16. A paving apparatus for spreading paving material on a surface, said paving material exhaling noxious fumes, said apparatus comprising:

an engine of the paving apparatus having an intake and adapted to burn fumes received through the intake;

a hood for collecting the fumes;

a duct connected between the hood and the intake of the engine; and a suction means for urging the fumes into the hood, through the duct and into the engine.

17. A method of reducing fumes exhaled from paving material carried in a paving material conveyance, comprising the steps of:

collecting the fumes in a fume conduit;

directing the fumes to an intake of an engine of the paving material conveyance; and burning the fumes in the engine.

18. A method according to claim 17, further comprising the steps of separating the fumes and directing part of the fumes into an exhaust flow from the engine.

* * * * *